US008480324B2

(12) United States Patent
Rolion et al.

(10) Patent No.: US 8,480,324 B2
(45) Date of Patent: Jul. 9, 2013

(54) WRITING IMPLEMENT WITH HINGED CLIP

(75) Inventors: Franck Rolion, Asnieres sur Oise (FR); Samuel Malinverni, Paris (FR)

(73) Assignee: Societe Bic, Clichy (FR)

( * ) Notice: Subject to any disclaimer, the term of this patent is extended or adjusted under 35 U.S.C. 154(b) by 359 days.

(21) Appl. No.: 12/994,398

(22) PCT Filed: May 20, 2009

(86) PCT No.: PCT/FR2009/050948

§ 371 (c)(1),
(2), (4) Date: Nov. 23, 2010

(87) PCT Pub. No.: WO2009/153482

PCT Pub. Date: Dec. 23, 2009

(65) Prior Publication Data

US 2011/0076087 A1 Mar. 31, 2011

(30) Foreign Application Priority Data

May 23, 2008 (FR) ..... 08 53383

(51) Int. Cl.
*B43K 23/02* (2006.01)

(52) U.S. Cl.
USPC ..... 401/131; 24/11 R

(58) Field of Classification Search
USPC ..... 401/131, 104–106; 24/11 R, 11 HC, 24/11 M, 11 P, 12
See application file for complete search history.

(56) References Cited

U.S. PATENT DOCUMENTS

| | | | | |
|---|---|---|---|---|
| 1,808,045 | A * | 6/1931 | Krause | 24/11 P |
| 3,344,484 | A * | 10/1967 | Zepell et al. | 24/11 P |
| 3,825,976 | A * | 7/1974 | Moore | 24/11 F |
| 4,551,034 | A | 11/1985 | Zepell | |
| 5,152,626 | A * | 10/1992 | Eppler | 401/104 |
| 6,685,374 | B1 | 2/2004 | Cetera | |
| 7,018,123 | B1 | 3/2006 | Cetera | |
| 2004/0099777 | A1 | 5/2004 | Fujihara et al. | |
| 2007/0243011 | A1 | 10/2007 | Dalancourt | |
| 2008/0112749 | A1 | 5/2008 | Ono et al. | |

FOREIGN PATENT DOCUMENTS

| | | |
|---|---|---|
| DE | 20 2006 00306 | 6/2006 |
| EP | 1847403 | 10/2007 |
| JP | 08-258488 | 10/1996 |
| JP | 2007-130891 | 5/2007 |
| JP | 2007-253329 | 10/2007 |

* cited by examiner

*Primary Examiner* — David Walczak
(74) *Attorney, Agent, or Firm* — Jones Day

(57) ABSTRACT

A writing implement that includes a tubular body that extends longitudinally along a central axis and has an outer surface, and a clip that includes an arm that extends parallel to the central axis, between a front end and a back end near which a first and a second flange extend towards the body element. The flanges are mounted on a pivot shaft in a direction perpendicular to the central axis, and around which the clip pivots between a closed position in which the arm comes in contact with the implement, and an open position. The outer surface of the body element has a first and a second sunken region, one on each side of a first longitudinal plane passing through the central axis, and from which protrude a first and a second pin both extending collinearly to the pivot shaft.

15 Claims, 3 Drawing Sheets

WRITING IMPLEMENT WITH HINGED CLIP

CROSS REFERENCE TO RELATED APPLICATION

This application is a national stage application of International Application No. PCT/FR2009/050948, filed on May 20, 2009, which claims the benefit of French Patent Application No. 0853383 filed on May 23, 2008, the entire contents of both applications being incorporated herein by reference.

FIELD OF INVENTION

The embodiments of the present invention relate to a writing implement having a tubular body element extending longitudinally along a central axis and having an outer surface, and a clip having an arm extending substantially parallel to the central axis, between a front end and a back end near which a first and a second flange extend towards the body element. The flanges are preferably mounted on a pivot shaft and pivots in a direction perpendicular to the central axis, around which the clip pivots between a closed position, in which the arm comes in contact with the implement, and an open position.

BACKGROUND OF THE EMBODIMENTS OF THE PRESENT INVENTION

Clips of this type are known, particularly from document EP1847403 A. Clips hinged relative to the body of the implement in this manner are easier to open and generally open to a wider angle than clips connected to the body by a more or less rigid base that is attached to or is an integral part of the body element.

However, the need for a pivot shaft often results in disadvantages related to the overall dimensions of the pen. The pivot shaft is usually supported by one or more projections outside the tubular element of the body and therefore the clip is quite prominent, as can be seen in the figures in document EP 1847403 A. To reduce this problem, it has been proposed to have portions of the body which have a reduced cross-section near the pivot shaft, such as the back end of the body described in document EP 1847403 A, or to have the flanges pass through openings in the tubular body element in order to pivot around a hinge located inside the body. The main disadvantage of these solutions is that this reduces the available space inside the tubular element and often does not allow the mechanism, or an ink cartridge inside that portion of the body. This is particularly cumbersome when creating a writing implement with a retractable point controlled by a rear button and the clip must be connected to the body in the rear portion of the body.

SUMMARY OF THE EMBODIMENTS OF THE PRESENT INVENTION

An embodiment of the present invention is directed to a hinged clip disposed on a pivot shaft, having limited overall dimensions while preserving as much as possible the space within the tubular element of the body on which the clip is mounted.

For this purpose, an object of an embodiment of the present invention is a writing implement of the type described above, wherein the outer surface of the body element has a first and a second sunken region, one on each side of a first longitudinal plane passing through the central axis, and from which project a first and a second pin both extending collinearly to the pivot shaft, and wherein each of the first and second flanges has a portion located in the first and second sunken regions and comprises a housing in which the corresponding pin pivots.

Because of this arrangement, the pivot shaft passes inside the volume defined by the outer surface of the body element. However, assembly of the clip does not require any device within the space inside the tubular element forming this part of the body. The space inside the tubular element may even have a cross-section which remains constant along its entire length if the sunken regions are of a depth less than the thickness of the tubular element in this area.

Additionally, the fact that a portion of each of the flanges is within these sunken regions laterally immobilizes the clip.

Preferred embodiments of the present invention can make use of one or more of the following arrangements:

the first and second pins are arranged between a second longitudinal plane comprising the central axis and perpendicular to the first longitudinal plane, and a plane parallel to the second plane and tangential to the outer surface facing the arm of the clip, the pivot shaft is located at a distance from the second longitudinal plane which represents between 20% and 60% of the radius of the outer surface, and preferably 50% of this radius; these arrangements provide an advantageous compromise between how far the clip can pivot, the length of its flanges, and the overall dimensions of the clip and body element as a whole, the first and second sunken regions have a depth less than the thickness of the tubular body element, the portion of the first and second flanges respectively arranged in the first and second sunken regions is of a thickness substantially equal to the depth of these regions, and each of the first and second pins has a free end lying within the volume of the outer surface, and preferably tangential to this volume, which improves user comfort when holding the implement, the first and second flanges have a cross-sectional profile that is adapted to fit against the profile of the sunken regions, the first and second sunken regions are at least partially delimited by a shoulder, and the first and second flanges have a contour adapted to come partially in contact with the corresponding shoulder in at least one of the open and closed positions of the clip, an elastic means is arranged in a third sunken region connecting the first and second sunken regions, and is adapted to bias the clip towards the closed position, the elastic means comprises a curved band with an arm pressing against the third sunken region and an arm pressing against the clip, the arm pressing against the clip has a curved end, the elastic means is assembled to have longitudinal play between the body element and the clip, at least one of the sunken regions of the body element has a window which cooperates with a device arranged inside the tubular body element.

This last arrangement takes advantage of the presence of the sunken regions which are almost completely hidden by the clip, and of the inner space preserved by this particular assembly, to facilitate molding the tubular body element during manufacture.

The body of a writing implement comprises internal devices, whether unmoving parts or moving elements of a mechanism, which can be snapped into a housing in the inner surface of the body in order to immobilize them or limit their movement. The formation of such inner housings in the form of blind holes requires complex molding pins and/or the assembly of several elements to form the body. The window, however, can easily be molded using an insert which moves radially to the central axis, and can serve, for example, to mold the sunken regions while remaining externally invisible.

BRIEF DESCRIPTION OF THE DRAWINGS

Other features and advantages will become apparent upon reading the following description provided as a non-limiting example, with reference to the figures in which:

In these figures, the same reference numerals are used to denote identical or similar elements.

FIG. 1 represents a writing implement 1 comprising a body 2, a clip 3, and an elastic means 4 visible in FIG. 3.

Figure 1:
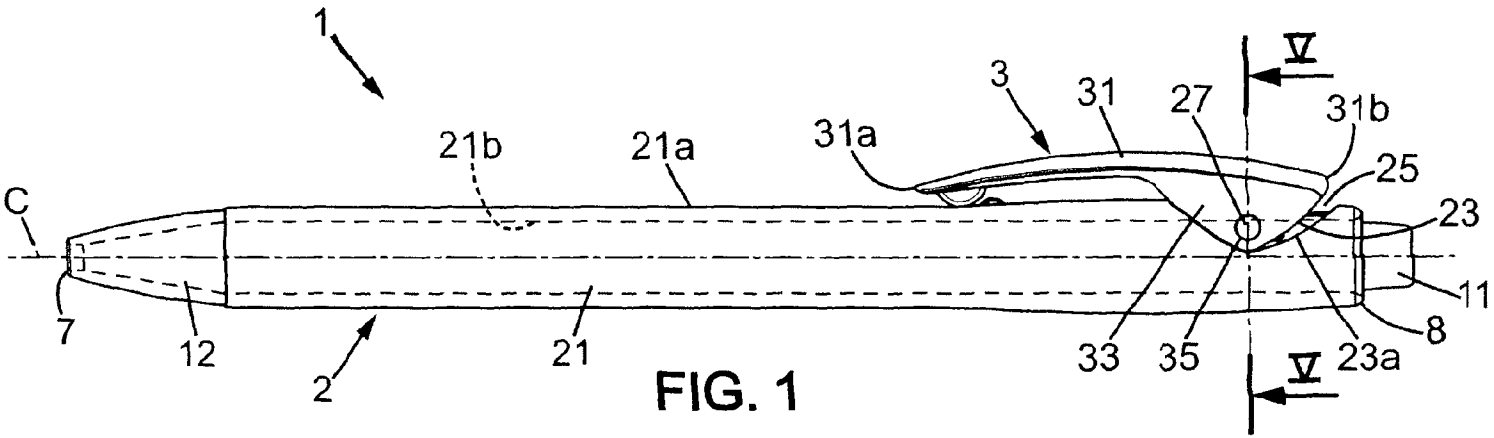
FIG. 1 is a side view of a writing implement comprising a body, an elastic means, and an embodiment of the clip of the present invention, with the clip in the closed position.

The body 2 preferably extends longitudinally along a central axis C, between a front end 7 and a back end 8. The front end 7 comprises an opening through which a writing tip, not visible because it is retracted, can protrude. At the back end 8, the writing implement has a push button 11 which activates a mechanism, not represented, for retracting or extending the tip.

In the embodiment of the present invention represented, the body 2 is preferably made of two parts, a conical nose 12 and a barrel 21 screwed onto the conical nose.

The barrel 21 is a tubular body element, onto which the clip 3 is mounted in a hinged manner. Of course, the body 2 could comprise more elements assembled in a manner than can or cannot be disassembled. In particular, the body 2 could comprise a removable cap to protect the writing tip, and in this case the body element could consist of all or part of the cap. It is therefore understood that the writing implement can be an implement with a non-retractable point.

The body element 21 has a substantially cylindrical outer surface 21*a* with a radius, slightly larger near the back 8, which varies very little along its entire length. Variations in the cross-section are, however, possible.

This tubular body element 21 has an inner surface 21*b* which, in the embodiment of the present invention represented, is cylindrical and can therefore be easily molded using one or two longitudinal molding pins. The inside space so defined can house an ink cartridge and, as is shown in the embodiment represented, its retraction/protrusion mechanism activated by the push button 11 enters this inside space. This could also be a lead advancement mechanism, for example. Numerous means for immobilizing such devices within the inside space can be used, but an advantageous solution will now be described.

Figure 3:
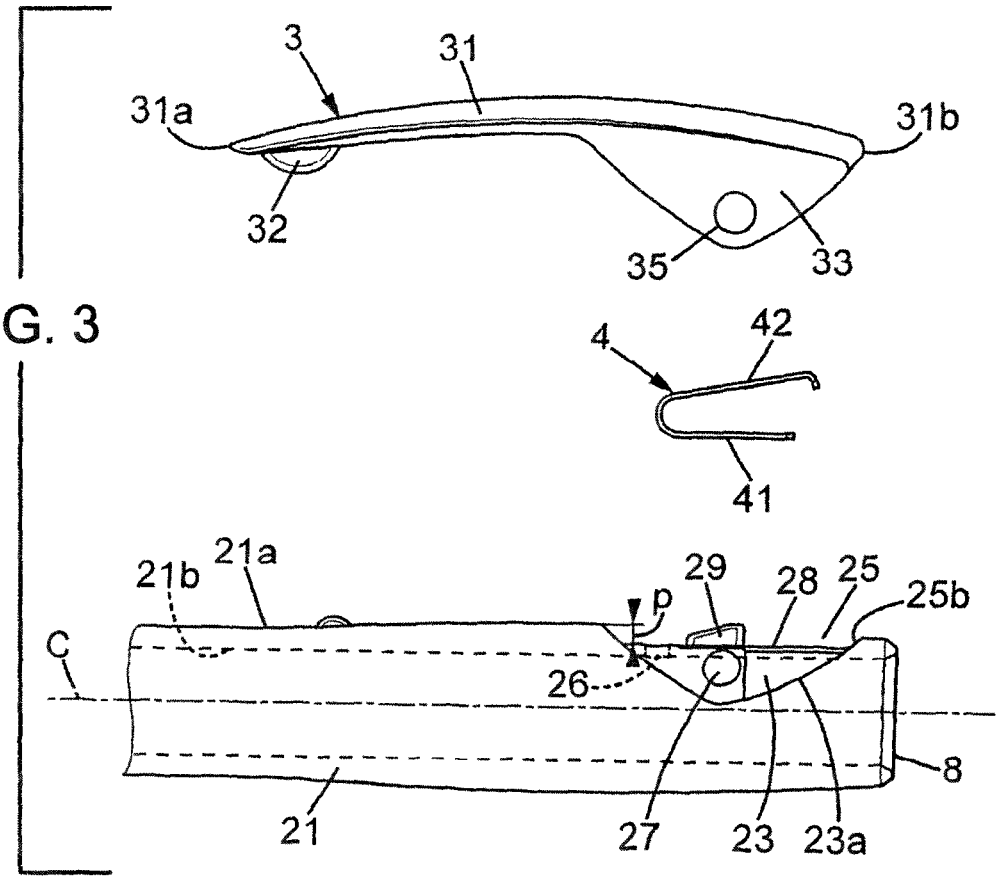
FIG. 3 is a partial exploded view of FIG. 1, in which the elastic means is visible.
Figure 4:
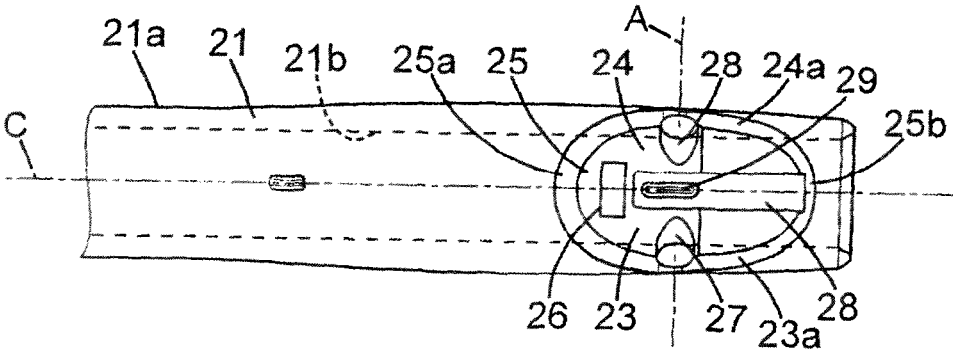
FIG. 4 is a partial top view of the body of FIG. 1.

The body element 21 preferably has a first sunken region 23 near the back end 8, more clearly visible in FIG. 3, and a second sunken region 24 visible in FIG. 4. These first and second sunken regions (23, 24) are arranged on each side of a longitudinal plane passing through the central axis C, its line merged with this axis in FIG. 4 and the line P1 visible in FIG. 5. This first longitudinal plane P1 is aligned with the clip 3.

The first and second sunken regions (23, 24) are preferably partially delimited by a shoulder (23*a*, 24*a*) forming an angle to the outer surface 21*a* and the bottom of the sunken regions.

The surface of the shoulders (23*a*, 24*a*) is preferably sloped, and not at a right angle to the outer surface 21*a*, in order to allow removing inserts or production mold halves in one or two directions radial to the central axis C.

A third sunken region 25 is formed between the first two such that these three zones together form a continuous recess delimited by the shoulders (23*a*, 24*a*) of the first two and shoulder portions (25*a*, 25*b*) of the third. The shoulders (25*a*, 25*b*) of the third region are also sloped and form a continuous contour with the shoulders (23*a*, 24*a*) to facilitate molding.

The sunken regions (23, 24, 25) have a depth p measured between their bottom and the volume of the outer surface 21*a*, which is less than the thickness of the tubular body element 21 in the portion considered here, meaning the area of the outer surface 21*a* surrounding these regions. Thus, the sunken regions (23, 24, 25) do not protrude beyond the inside surface 21*b*, which could reduce the usable volume of the inside space. Of course, the thickness of the material in the sunken regions must be sufficient to resist normal mechanical stresses during use. Stresses on these small surface areas are generally much lower than the bending stresses on the elongated body element 21 as a whole.

A first pin 27 extends from the bottom of the first sunken region 23 along a given axis A which forms the pivot shaft for the clip 3. This pivot shaft A extends in a direction perpendicular to the central axis C, but not necessarily secant to the central axis C. As is visible in FIG. 4, the second sunken region 24 has a second pin 28 which is analogous to the first and extends along the same pivot shaft A.

The cross-section of the first and second pins (27, 28), circular in this case, preferably allows a part to pivot around the pin. This cross-section also gives the pin a mechanical strength that is appropriate for its use. As it is preferably made of plastic, the cross-section is therefore not insignificant relative to the internal and external radial dimensions of the body element 21.

Figure 5:
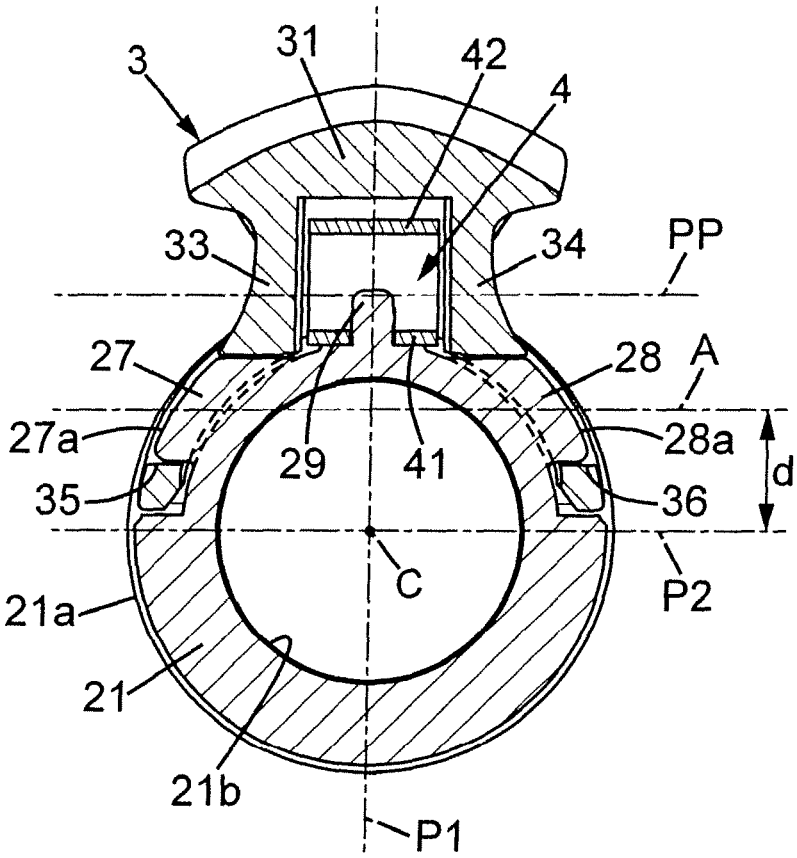
FIG. 5 is a cross-sectional view along line V-V in FIG. 1.

As can be seen in FIG. 5, the first and second pins (27, 28) each have a free end formed by a surface (27*a*, 28*a*) which extends into the volume of the outer surface 21*a*. With the free ends (27*a*, 28*a*) within this volume, the overall outside dimensions are not increased in any way. In addition, due to the fact that the surface of these free ends (27*a*, 28*a*) is preferably tangential, or at least parallel, to the volume of the substantially cylindrical outer surface 21*a*, these free ends are sloped towards the clip 3 and allow assembling the clip by snapping it into place.

The clip 3 comprises an elongated arm 31 that extends between a front end 31*a* and a back end 31*b* in a direction which is approximately parallel to the central axis C when the clip is in the closed position represented in FIG. 1. In a manner that is well known, the front end 31*a* comprises on its lower side, facing the body element 21, a protuberance 32 that is in contact with the body element and near a projection from the element when in the closed position.

A first flange 33 preferably extends from the arm 31 of the clip, and in a rear portion of the clip, towards the body element 21. As can be seen in FIG. 5, a second flange 34, preferably analogous to the first one, also extends from the same region of the clip arm 31. The first and second flanges (33, 34) are preferably arranged symmetrically on each side of the first longitudinal plane P1. Note that the first and second flanges (33, 34) extend from the lower surface of the arm 31 and at a distance from the lateral edges of the arm, such that the cross section of this part of the clip 3 has a Π shape rather than an inverted U shape. In any event, the overall dimensions along the pivot shaft A of the clip are much less than the diameter of the tubular element 21.

One will also note in FIG. 5 that the flanges (33, 34) have a profile which fits against the profile of the first and second sunken regions, at least for the end portion arranged in these sunken regions. The thickness of the flanges (33, 34) corresponds to the depth p of the sunken regions. The clip is thus prevented from translational movement in the direction of the pivot shaft A, without the ends of the flanges protruding beyond the volume of the outer surface 21*a*.

Figure 2:
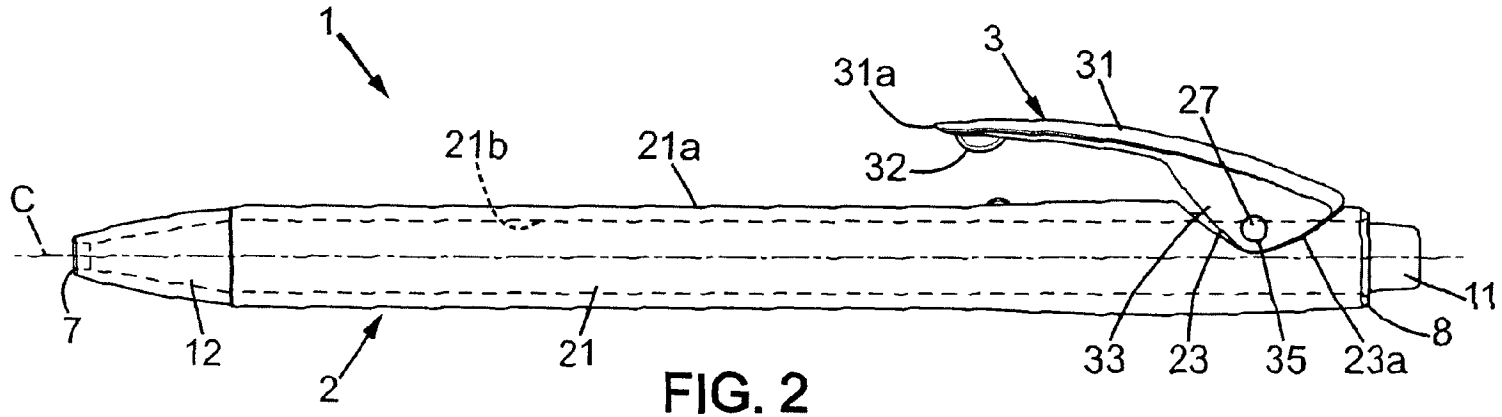
FIG. 2 is a view analogous to that of FIG. 1 but with the clip in the open position.

As can be seen in FIGS. 1 and 2, the side of the first flange 33 has a generally triangular contour when viewed straight on. This contour fits, with some play, into the contour of the first sunken region 23 defined by its shoulder 23*a*. Thus, the clip 3 can pivot within a predetermined angle between the closed position represented in FIG. 1 and the open position represented in FIG. 2. In addition, the flange contour forms shapes complementary to the shoulder 23*a*, limiting the gaps between these elements. The adaptation of this contour to the shoulder 23*a* also creates areas of contact that act as stops when the clip is in the closed and open positions. In the open position, the back end 31*b* of the arm can come into contact with the shoulder 25*b* of the third sunken region 25 as well.

Nevertheless, these functions could be fulfilled by flanges having a substantially different contour from the generally triangular shape represented. The contour could be more U-shaped and the shoulder more V-shaped when viewed from the side, or the contour could be more similar to a half-ellipse, depending on the aesthetics desired. Other areas of contact can of course be provided to limit clip travel, particularly on the inside face near the back end.

The first flange 33 also comprises a housing 35 for receiving the pin 27 of the first sunken region 23, in a manner that allows the clip to pivot between the closed and open positions around the axis A. The housing 35 is in the form of a cylindrical through-hole. The second flange 34 comprises an identical housing 36. Of course other forms, particularly pocket holes, are possible to enable pivoting. A through-hole allows the entire thickness of each flange (33, 34) to cooperate with the corresponding pin (27, 28), giving more solidity to the hinge created. In addition, because of the specific shape of the free ends (27*a*, 28*a*) of the pins and the profile of the flanges, an outer surface that is continuous with the body element 21 is conserved.

As is apparent in FIGS. 3 and 5, the elastic means 4 is located between the body element 21 and the clip 3 in order to elastically bias the clip in the direction of the closed position. More specifically, in the embodiment represented, the elastic means 4 is formed by a curved metal band. An elastic means in the form of a coiled spring, rubber element, and other elastic means known in the art can of course be considered.

This elastic means 4 preferably has a first rectilinear arm 41 and a second rectilinear arm 42 arranged in a V and connected by a curved section. The elastic means is advantageously arranged against the third sunken region 25, to reduce its radial dimensions and hide it between the flanges (33, 34) and the arm 31 of the clip. Assembly of an elastic means 4 in the form of a curved band is facilitated by the flat portion 28 and the shank 29 of the third sunken region 25 against which the first arm presses. Passing the shank 29 through an opening in the first arm 41 advantageously immobilizes the elastic means 4 during assembly, but this is not indispensable. The second arm 42 presses against the lower side of the arm 31 in a region located between the pivot shaft A and the back end 31*b* of this arm 31. The aperture of the elastic means 4 at rest is chosen so that it exerts an outward radial pressure in this region of the clip which tends to return the clip 3 to the closed position.

Figure 6:
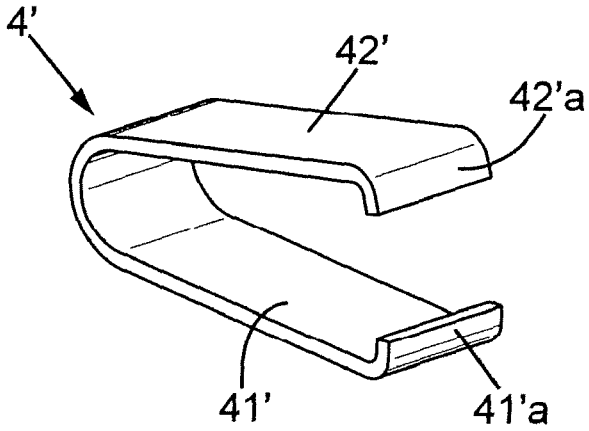
FIG. 6 represents a perspective view of one variant of an embodiment of the elastic means of the previous figures.

However, in a preferred embodiment, the elastic means is made of a metal band 4', visible in FIG. 6, of a somewhat different shape than the elastic means 4 visible in FIG. 3. In this variant, the two arms (41', 42') are preferably solid and preferably identical shape. Thus, there is no longer a required up/down orientation for assembly and production of the writing implement is simplified. Of course, for this embodiment, the third sunken region 25 of the body has no shank 29. The elastic means 4' is then mounted in a less restricted manner, particularly regarding longitudinal play. The extent of this reduced play, about a millimeter, can be limited by the front and back edges of the third sunken housing 25, but also by one or more raised areas on the lower side of the clip. This possibility of longitudinal play is beneficial to the smoothness and regularity of the elastic return of the clip 3 to the closed position. The free ends (41'*a*, 42'*a*) of the arms are preferably both curved for the same reason. The lower side of the arm 31 has a portion of flat surface against which a curved end 41'*a* or 42'*a* cooperates.

The hinged assembly of the clip 3 onto the body 2 of the writing implement provides a significant gap between the front end 31*a* of the arm and the body when in the open position; this gap is useful for hooking the writing implement onto a thick object. The stress is constant along the entire travel path and for the service life of the writing implement which is much more satisfactory than rigid clips solidly integrated with the body. In addition, an assembly according to an embodiment of the present invention retains inside and outer dimensions, as well as usability, which are almost identical to those of the usual rigid, solidly integrated clips. This is primarily due to the combination of sunken regions (23, 24) and to forming a pivot shaft A which passes within the volume of the outer surface 21*a* of the body element 21.

However, a more satisfactory compromise between parameters such as the external overall dimensions, the pivot angle, and usability is obtained when the first and second pins (27, 28) are arranged between a second longitudinal plane along line P2 in FIG. 5, which comprises the central axis C and is preferably perpendicular to the first longitudinal plane P1; and a plane parallel to the second plane, along line PP, which is tangential to the outer surface 21*a* facing the clip 3. More specifically, the pivot shaft A is preferably situated at a distance d from the second longitudinal plane P2, measured radially towards the clip 3, which represents between 20 and 60% of the radius of the outer surface 21*a* in the cross-section considered. A larger distance to the plane P2 requires a larger pivot angle and reduces the solidity of the hinge. A distance of about 50%, as in the embodiment represented, is satisfactory.

For assembling a mechanism inside the tubular body 2, there can advantageously be one or more windows located in one of the sunken regions (23, 24, 25) and communicating with the inside space of the body element 21, for example, see the window 26 visible in FIG. 4. An element inserted into the inside space can have a radially elastic means, which snaps in place in the window 26 when it reaches the corresponding longitudinal position. This retains the ease of interior molding using a pin of a substantially constant cross-section, while providing a particularly simple assembly by the insertion of any known mechanism.

The invention claimed is:

1. A writing implement comprising:

a tubular body element extending longitudinally along a central axis and having an outer surface, and a clip comprising an arm extending substantially parallel to the central axis, between a front end and a back end, near which a first and a second flange extend towards the body element, the flanges being mounted on a pivot axis in a direction perpendicular to the central axis, and around which the clip pivots between a closed position in which the arm comes in contact with the implement, and an open position, wherein the outer surface of the body element has a first and a second sunken region, one on each side of a first longitudinal plane passing through the central axis, and from which protrude a first pin and a second pin, both extending collinear to the pivot axis, wherein each of the first and second flanges has a portion located in the first and second sunken regions and comprises a housing in which the corresponding pin pivots, and wherein the portion of the first and second flanges arranged in the first and second sunken regions is of a thickness substantially equal to the depth of these regions, the depth of a region being measured between the bottom of the region and the volume of the outer surface of the body element, and each of the first and second pins has a free end within the volume of the outer surface, and tangential to this volume.

2. The implement according to claim 1, wherein the first and second pins are arranged between a second longitudinal plane comprising the central axis and perpendicular to the first longitudinal plane, and a plane parallel to the second longitudinal plane and tangential to the outer surface facing the arm of the clip.

3. The implement according to claim 2, wherein the first and second flanges have a cross-sectional profile that is adapted to fit against the profile of the first and second sunken regions.

4. The implement according to claim 2, wherein an elastic means is arranged in a third sunken region connecting the first and second sunken regions and is adapted to bias the clip towards the closed position.

5. The implement according to claim 2, wherein the pivot axis is located a distance from the second longitudinal plane, which represents between 20% and 60% of the radius of the outer surface.

6. The implement according to claim 5, wherein the distance from the second longitudinal plane represents 50% of the radius of the outer surface.

7. The implement according to claim 1, wherein the first and second sunken regions have a depth that is less than the thickness of the tubular body element.

8. The implement according to claim 1, wherein the first and second flanges have a cross-sectional profile that is adapted to fit against the profile of the first and second sunken regions.

9. The implement according to claim 1, wherein the first and second sunken regions are at least partially delimited by a shoulder, and the first and second flanges have a contour adapted to come partially in contact with the corresponding shoulder in at least one of the open and closed positions of the clip.

10. The implement according to claim 1, wherein an elastic means is arranged in a third sunken region connecting the first and second sunken regions, and is adapted to bias the clip towards the closed position.

11. The implement according to claim 10, wherein the elastic means comprises a curved band with an arm pressing against the third sunken region and an arm pressing against the clip.

12. The implement according to claim 11, wherein the arm pressing against the clip has a curved end.

13. The implement according to claim 10, wherein the elastic means is assembled to have longitudinal play between the body element and the clip.

14. The implement according to claim 1, wherein at least one of the sunken regions of the body element has a window which cooperates with a device arranged inside the tubular body element.

15. The implement according to claim 1, wherein the free ends of the first and second pins are sloped towards the clip.

* * * * *